US010197341B2

(12) United States Patent
Citti et al.

(10) Patent No.: US 10,197,341 B2
(45) Date of Patent: Feb. 5, 2019

(54) HEAT EXCHANGER FOR MOTOR VEHICLE

(71) Applicant: Valeo Systemes Thermiques, Le Mesnil Saint Denis (FR)

(72) Inventors: Isabelle Citti, Rosnay (FR); Sébastien Jacope, Beaumont sur Vesle (FR); Anne-Sylvie Magnier-Cathenod, Saint-Cloud (FR); Carlos Martins, Le Chesnay (FR)

(73) Assignee: Valeo Systemes Thermiques, Le Mesnil Saint Denis (FR)

( * ) Notice: Subject to any disclaimer, the term of this patent is extended or adjusted under 35 U.S.C. 154(b) by 0 days.

(21) Appl. No.: 15/115,292

(22) PCT Filed: Jan. 30, 2015

(86) PCT No.: PCT/EP2015/051952
§ 371 (c)(1),
(2) Date: Jul. 29, 2016

(87) PCT Pub. No.: WO2015/114101
PCT Pub. Date: Aug. 6, 2015

(65) Prior Publication Data

US 2017/0010054 A1 Jan. 12, 2017

(30) Foreign Application Priority Data

Jan. 30, 2014 (FR) ..... 14 50740

(51) Int. Cl.
*F28F 9/02* (2006.01)
*F28F 1/02* (2006.01)

(52) U.S. Cl.
CPC ..... *F28F 9/02* (2013.01); *F28F 1/02* (2013.01); *F28F 9/0229* (2013.01); *F28F 2225/08* (2013.01)

(58) Field of Classification Search
CPC .... F28F 9/02; F28F 9/0229; F28F 9/22; F28F 9/0282; F28F 9/0221; F28F 1/02;
(Continued)

(56) References Cited

U.S. PATENT DOCUMENTS 3,993,126 A * 11/1976 Taylor ..... F28F 9/162 156/296
5,123,482 A * 6/1992 Abraham ..... F28D 1/0535 165/173

(Continued)

FOREIGN PATENT DOCUMENTS

DE 102007016050 A1 10/2007
FR 2992713 A1 1/2014
WO 2005088219 A1 9/2005

OTHER PUBLICATIONS

International Search Report issued in corresponding application No. PCT/EP2015/051952 dated Apr. 28, 2015 (4 pages).

(Continued)

*Primary Examiner* — Tho V Duong
(74) *Attorney, Agent, or Firm* — Osha Liang LLP

(57) ABSTRACT

The invention relates to a heat exchanger (1), especially an exchanger for the air-conditioning system of a vehicle, allowing heat exchange between first (F1) and second (F2) fluids, said exchanger (1) comprising a plurality of tubes (3) for the circulation of the first fluid (F1), which are stacked one on top of the other, and at least one collector (5) comprising a collector plate (7), said collector plate (7) comprising openings (13) for inserting the ends (3*a*) of tubes (3), characterized in that said ends (3*a*) of said (3) are assembled at least two by two in the insertion openings of the collector plate (7).

14 Claims, 3 Drawing Sheets

Figure 1:
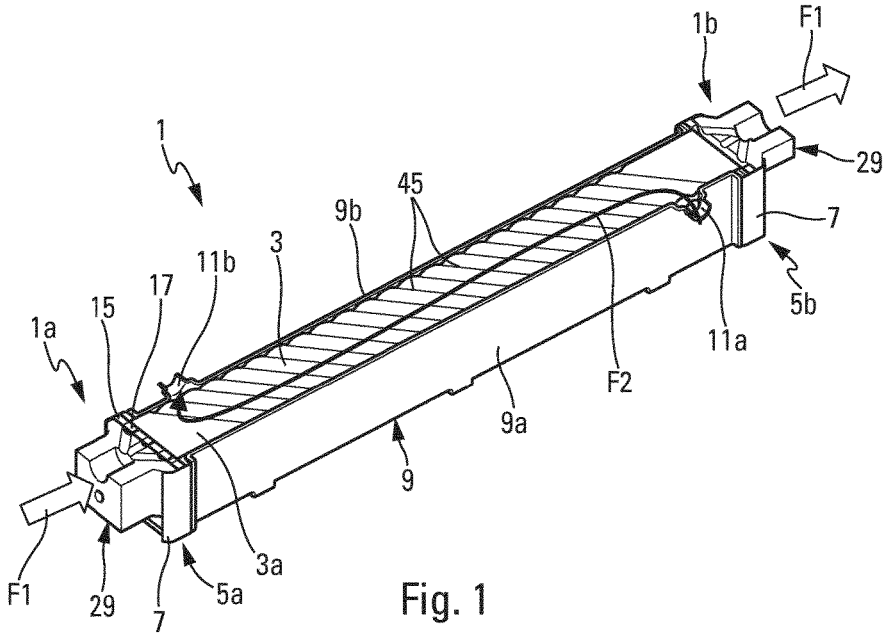

(58) Field of Classification Search
CPC ..... F28F 1/025; F28F 2009/0285; F28F 2225/08; F28D 1/05358; F28D 1/05366
USPC ..... 165/173
See application file for complete search history.

(56) References Cited

U.S. PATENT DOCUMENTS

| | | | | |
|---|---|---|---|---|
| 6,810,951 | B1 * | 11/2004 | Dumetz | F28F 9/182 165/173 |
| 6,827,139 | B2 * | 12/2004 | Kawakubo | F28D 1/0476 165/173 |
| 7,604,044 | B2 * | 10/2009 | Kawakubo | F28D 1/05375 165/175 |
| 7,637,314 | B2 * | 12/2009 | Park | F28F 9/0221 165/174 |
| 8,322,407 | B2 * | 12/2012 | Reynolds | F24H 3/0429 165/173 |
| 2006/0185833 | A1 * | 8/2006 | Brost | F28D 1/05366 165/149 |
| 2007/0023172 | A1 * | 2/2007 | Obrist | F28D 1/0246 165/153 |

OTHER PUBLICATIONS

Written Opinion of the International Searching Authority issued in corresponding application No. PCT/EP2015/051952 dated Apr. 28, 2015 (5 pages).

* cited by examiner

HEAT EXCHANGER FOR MOTOR VEHICLE

The object of the present invention is a heat exchanger, in particular for an air-conditioning fluid circuit of a vehicle, and more particularly a fluid/fluid type exchanger intended to carry a high-pressure fluid.

Heat exchangers for vehicle air-conditioning fluid circuits are likely to carry a refrigerant fluid in supercritical state, such as carbon dioxide ($CO_2$). This fluid essentially remains in the gaseous state and under a high operating pressure which normally lies between 100 and 150 bar. It is therefore necessary for such heat exchangers to resist such pressures, and to this end a burst pressure is provided which is generally substantially equivalent to three times the value of the operating pressure.

In general, such exchangers comprise a plurality of flat tubes stacked one above the other and having circulation channels for a first fluid, wherein a second fluid circulates between the tubes. Each end of the tubes is connected to a collector allowing distribution of the first fluid at one end and its collection at the other end. This creates heat exchangers which take up little space while retaining useful characteristics. The fragility of these exchangers generally lies in the zone of cooperation between the tube ends and the collector.

To remedy these drawbacks, there is a need for a heat exchanger which is resistant to high pressure and in which the cooperation zone is reinforced. Such an exchanger must remain compact, and be as small as possible while retaining the characteristics necessary for an efficient heat exchanger.

To this end, the invention proposes a heat exchanger, in particular an exchanger for an air-conditioning circuit of a vehicle, allowing an exchange of heat between first and second fluids, said exchanger comprising a plurality of tubes for circulation of the first fluid stacked on top of each other, and at least one collector comprising a collector plate, said collector plate comprising openings for insertion of the ends of the tubes, characterized in that said ends of said tubes are assembled at least two by two in a same of said insertion openings of the collector plate.

In other words, the assembly of the tube ends at least in pairs leads to a heat exchanger which is compact and small, wherein tubes of the same tube assembly, in particular the tubes of the same tube pair, reinforce each other at the level of the cooperation zone of the exchanger. Furthermore, in the present invention, the space between two tube assemblies, in particular between two tube pairs, is increased relative to an exchanger in which each tube end is connected to the collector separately, which allows reinforcement of the cooperation zone between the tube ends and collector by various reinforcing means and leads to a strong heat exchanger.

According to various embodiments of the invention which may be taken together or separately:

said collector comprises an intermediate reinforcing plate comprising openings for passage of the fluid and resting on said collector plate, said reinforcing plate comprises webs, said collector plate comprises collars bordering said openings of said collector plate, said collector is configured such that said collars rest on said webs, each of said webs is in contact with a lower part and an upper part of a collar bordering two adjacent openings of said openings of said collector plate, said openings of said reinforcing plate have a dimension which is greater than the dimension of the openings of said collector plate, said collector comprises a cover, said reinforcing plate forms a brace between said cover and said collector plate, said collector plate borders the cover and said reinforcing plate longitudinally so as to form an integral assembly, said heat exchanger also comprises a supplementary plate allowing brazing of said cover and said reinforcing plate together, said cover defines a plurality of chambers in said collector, said heat exchanger comprises a flange allowing the supply of each of the chambers of said collector, said flange comprises a number of conduits equivalent to the number of chambers of the collector, said tubes are undulating, said tubes comprise at least one undulating line extending obliquely relative to the longitudinal axis of the tube, said stacked tubes are in contact with each other between their ends, said tubes are in contact with each other at the tips of their undulations, said tubes are brazed together at the contact points, said tubes are extruded, said tubes have a cross-section adapted such that the cross-section formed by the ends of the tubes of said assembled tubes is oblong, said cross-section has two opposing and substantially rectilinear long sides connected by a radius formed in combination by a short side of each of the tubes of the corresponding tube pair, one of the two fluids is a gas under high pressure and the other fluid is a liquid.

The invention will be better understood and further aims, details, characteristics and advantages thereof will appear more clearly during the detailed explanatory description below of at least one embodiment of the invention, given as a purely illustrative and non-limitative example, with reference to the attached diagrammatic drawings.

Figure 2:
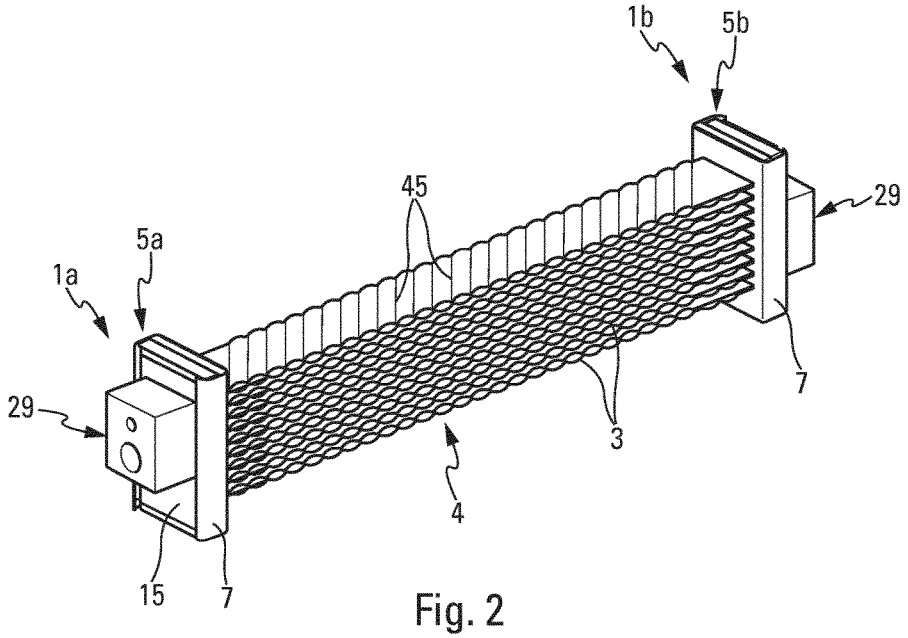
Figure 3:
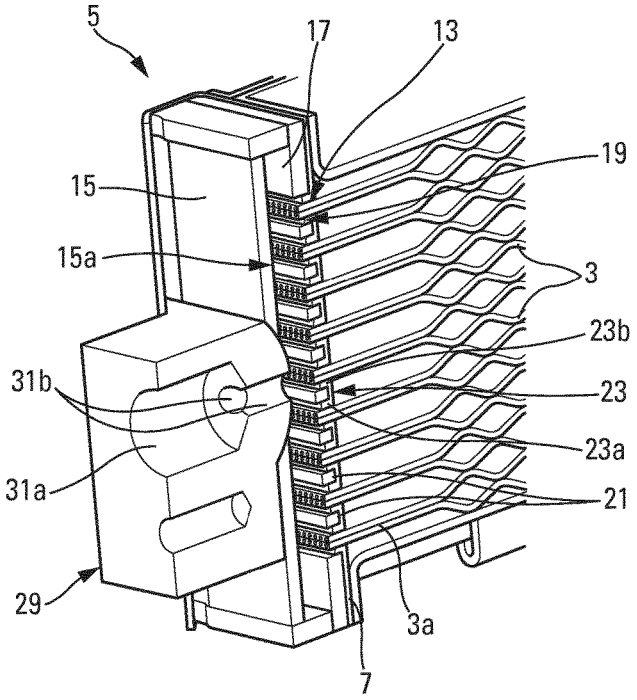
Figure 4:
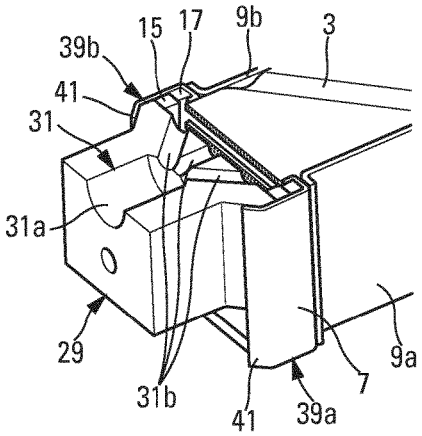
Figure 5:
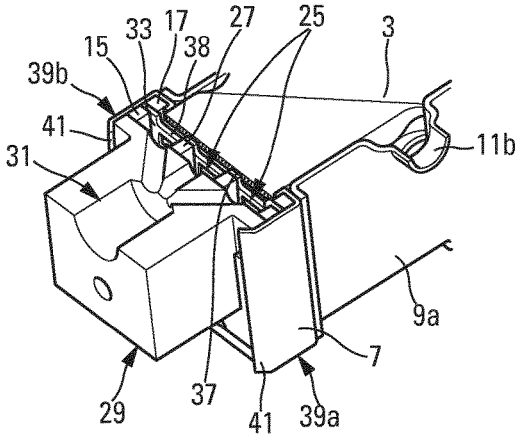
Figure 6:
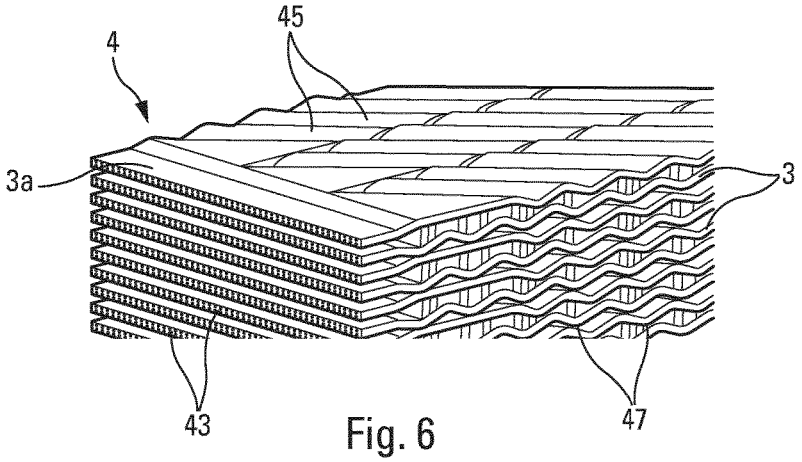
Figure 7:
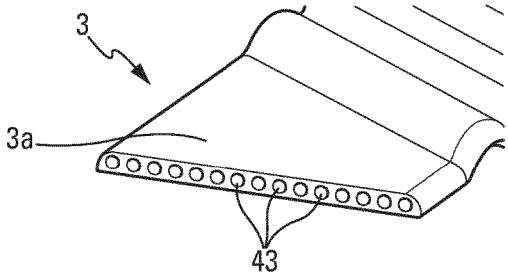
Figure 8:
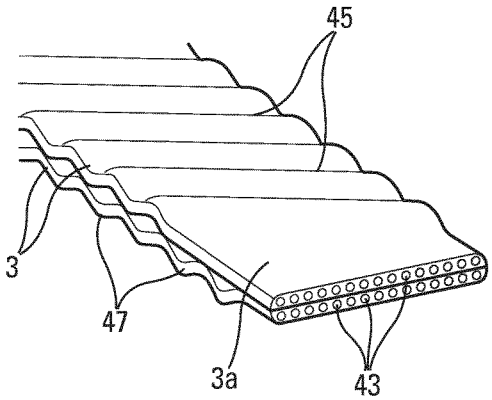

On the drawings:

FIG. 1 is a perspective view in longitudinal section of a heat exchanger according to the invention viewed from above, FIG. 2 is a perspective view of the inside of the exchanger shown in FIG. 1, FIG. 3 is a perspective view in longitudinal section of an end of the exchanger shown on FIG. 1, viewed from the side, FIG. 4 is a detail view of FIG. 1 showing a collector, FIG. 5 is a view similar to FIG. 4 showing another embodiment of the collector according to the invention, FIG. 6 is an exploded view of several tubes used in the exchanger of FIG. 1, FIG. 7 is a perspective view of a tube end used in the exchanger of FIG. 1, in cross-section, FIG. 8 is a perspective view of two tubes used in the exchanger of FIG. 1, the ends of which are assembled.

As illustrated in the various figures, the invention concerns a heat exchanger 1, in particular an exchanger for a vehicle air-conditioning circuit, allowing an exchange of heat between a first fluid F1 and a second fluid F2. Said exchanger 1 comprises a plurality of tubes 3 for circulation of the first fluid F1 stacked on top of each other, and at least one collector 5 comprising a collector plate 7.

In the various embodiments shown, said exchanger 1, at each of its ends 1*a* and 1*b*, comprises a first and a second collector 5*a* and 5*b*. The first collector 5*a* is an inlet collector for the first fluid F1, which is here a high-pressure gas such as $CO_2$, and the second collector 5*b* is an outlet collector for this fluid F1. Each collector 5*a* and 5*b* is connected to the plurality of tubes 3, also called the bundle 4, by the collector plate 7. The first fluid F1 thus passes successively through said inlet collector 5*a*, said bundle 4 and said outlet collector 5*b*.

Said exchanger 1 here comprises a housing 9 formed of side walls 9*a* and 9*b*. Said walls 9*a* and 9*b* comprise an inlet opening 11*a* and/or an outlet opening 11*b* for the second fluid F2, which is here a heat transfer liquid, in particular glycolated water, circulating between the stacked tubes 3 so as to cool the first fluid F1.

To ensure maximum cooling, in the embodiment shown on the various figures, the inlet opening 11*a* of the second fluid F2 is situated at the end 1*b* where the outlet collector 5*b* of the first fluid F1 is situated, and the outlet collector 11*b* is situated opposite, i.e. at the end 1*a*, towards the inlet collector 5*a* of the first fluid F1. In this way, a contraflow circulation of said fluids is provided.

According to the invention, said collector plate 7 comprises openings 13 for insertion of an end 3*a* of the tubes 3, such that said ends 3*a* of said tubes 3 are assembled two by two in a same of said insertion openings 13 of the collector plate 7. This gives a collector with a compact and robust configuration.

Said collector 5 may also comprise a cover 15 and an intermediate plate, called the reinforcing plate 17.

Said reinforcing plate 17 is configured to form a brace between a wall 15*a* of the cover 15 and the collector plate 7. It comprises openings 19 for the passage of the fluid F1, facing the insertion openings 13 of the collector plate 7, such that the fluid F1 can circulate between the tubes 3 and the collector 5 through the openings 13, 19. Advantageously, said openings 19 of said reinforcing plate 17 have a dimension greater than the dimension of the openings 13 of said collector plate 7.

Between each of its openings 19, said collector plate 17 comprises webs 21 configured to rest on collars 23 bordering said openings 13 of said collector plate 7. In this way, each of said webs 21 is in contact with a lower part 23*a* and an upper part 23*b* of a same collar 23 bordering two adjacent openings 13. Said reinforcing plate 17 thus limits the risk of buckling of the collector plate 7 at the collars 23 bordering the insertion openings 13, and between said insertion openings 13, in particular when the heat exchanger 1 is intended for a high-pressure gas.

Said cover 15 may define a plurality of chambers 25 in said collector 5, as shown in FIG. 5. The cover 15 then comprises legs 27 delimiting on either side a chamber 25. Here, three parallel chambers 25 formed by two legs 27 are shown.

As shown here, the first fluid F1 may be supplied to and discharged from said collector 5 via a supply flange 29. Said supply flanges 29 may comprise several conduits 31. In particular in the case of a collector 5 comprising a plurality of chambers 25, said flange 29 comprises a number of conduits 31 equal to the number of chambers 25 of the collector 5, each conduit 31 supplying a chamber 25. Here, the flange 29 shown in FIGS. 1, 3 to 5 comprises a fluid inlet conduit 31*a*, which is divided into three evenly distributed conduits 31*b* which may have a cross-section smaller than that of the inlet conduit 31*a*, each of the three conduits 31*b* supplying one of the three chambers 25. This type of flange 29 associated with a plurality of chambers 25 allows a uniform distribution of fluid F1 into the different chambers 25 and an optimized supply, which may be advantageous in a heat exchanger for high-pressure gas.

Said flange 29 may be carried by said cover 15. The latter here has an opening allowing passage of the first fluid F1 into the collector 5.

In another embodiment, shown in FIG. 5, said heat exchanger 1 also comprises an additional plate 33 placed between the cover 15 and the reinforcing plate 17. Said additional plate 33 allows brazing of said cover 15 and said reinforcing plate 17 together. Advantageously, it is for example coated with a brazing alloy. The additional plate 33 has a surface of contour substantially identical to that of the reinforcing plate 17. Said additional plate 33 also comprises openings 35 for passage of the first fluid F1 facing the openings 13 of the collector plate 7 and the openings 19 of the reinforcing plate 17, in which the end 3*a* of a pair of tubes 3 will be inserted.

In the case of a collector 5 comprising several chambers 25, the additional plate 33 has legs 37 complementary to the legs 27 of the cover 15, delimiting each of the chambers 25. The cover 15 and the reinforcing plate 17 are thus brazed together over a large contact area.

Here, said additional plate 33 also comprises webs 38 situated opposite webs 21 of the reinforcing plate 17. Said webs 38 of the additional plate 33 and its legs 37 are orthogonal and define between them the openings 35 of said supplementary plate 33. In the example illustrated therefore, three openings 35 of the supplementary plate 33 are located facing one and the same opening 19 of the reinforcing plate 17.

As shown in FIGS. 1 to 5, said collector plate 7 comprises two external, parallel, side parts 39*a* and 39*b*, bordering the cover 15 and said reinforcing plate 17 longitudinally and terminating in a return 41 over its entire height in contact with said flange 29, so as to form an integral assembly with the cover 15 and said reinforcing plate 17.

In the various embodiments shown here, the tubes 3 are flat extruded tubes comprising a plurality of channels 43 for circulation of the first fluid F1, here a high-pressure gas. Said tubes 3 are deformed so as to form a plurality of undulating lines 45. The lines 45 are here parallel with each other and substantially identical.

Moreover, as shown in FIGS. 6 and 8, the undulating lines 45 extend obliquely relative to the longitudinal axis of the tube 3, and the tubes 3 are assembled so as to cross the undulating lines 45 of contiguous tubes 3. Said stacked tubes 3 are thus in contact with each other, in particular at the level of the parts of the tips 47 of the undulations called the contact points. Advantageously, said tubes 3 are brazed together at their contact points. Such a structure creates a sinuous network between the tubes 3 in order to disturb the circulation of the second fluid F2 and ensure an efficient exchange of heat between the two fluids F1 and F2. This further improves the robustness of the product.

Advantageously, at their ends 3*a*, the tubes may have a specific cross-section such that the cross-section formed by the two ends 3*a* of assembled tubes is oblong, advantageously formed with straight and/or convex portions.

As illustrated in the various FIGS. 3 and 6 to 9, the ends 3*a* of the tubes 3 are substantially flat, i.e. without undulating lines 45, so that they can be assembled two by two and inserted in the insertion openings 13 the collector plates 7 of each of the two collectors 5*a* and 5*b*, as has just been described.

Said tubes 3 may be configured such that they can be held longitudinally, such that their ends rest in the thickness of the reinforcing plate 17, set back from a face of said reinforcing plate 17 facing the interior of the collector 5, or set back from a free edge of said collars 23 of the collector plate 7.

Advantageously, all the elements of the exchanger 1 are brazed together in a single step, following one or more preassembly steps.

It should be noted that variant embodiments are of course possible and that the present invention is not limited to the embodiments described above.

For example, in an embodiment not shown, each insertion opening is dimensioned to receive at least two tubes.

The invention claimed is:

1. A heat exchanger for an air-conditioning circuit of a vehicle, allowing an exchange of heat between first and second fluids, said exchanger comprising:

a plurality of tubes for circulation of the first fluid stacked on top of each other, each of the plurality of tubes comprising two ends, wherein said plurality of tubes are undulating and contact each other at tips of undulations;

at least one collector comprising a collector plate, a cover, and an intermediate reinforcing plate, said collector plate comprising openings for insertion of the ends of the plurality of tubes, wherein said ends of said plurality of tubes are assembled at least two by two in a same of said insertion openings of the collector plate, wherein adjacent tubes are in contact with each other between ends of said adjacent tubes.

2. The heat exchanger as claimed in claim 1, said exchanger further comprising:

a supplementary plate comprising first webs, wherein said intermediate reinforcing plate comprises openings for passage of the fluid and rests on said collector plate, wherein said reinforcing plate forms a brace between said cover and said collector plate, and wherein said supplementary plate allows brazing of said cover and said reinforcing plate together.

3. The heat exchanger as claimed in claim 2, wherein said reinforcing plate comprises second webs, said collector plate comprises collars bordering said openings of said collector plate, and said collector is configured such that said collars rest on said second webs.

4. The heat exchanger as claimed in claim 3, wherein each of said second webs is in contact with a lower part and an upper part of a collar bordering two adjacent openings of said openings of said collector plate.

5. The heat exchanger as claimed in claim 1, wherein said openings of said reinforcing plate have a dimension which is greater than the dimension of the openings of said collector plate.

6. The heat exchanger as claimed in claim 1, wherein said collector plate borders the cover and said reinforcing plate longitudinally so as to form an integral assembly.

7. The heat exchanger as claimed in claim 1, wherein said cover defines a plurality of chambers in said collector.

8. The heat exchanger as claimed in claim 7, comprising a flange allowing the supply of each of the chambers of said collector.

9. The heat exchanger as claimed in claim 8, wherein said flange comprises a number of conduits equivalent to the number of chambers of the collector.

10. The heat exchanger as claimed in claim 1, wherein said plurality of tubes comprise at least one undulating line extending obliquely relative to the longitudinal axis of the tube.

11. The heat exchanger as claimed in claim 1, wherein said plurality of tubes have a cross-section adapted such that the cross-section formed by the ends of the plurality of tubes of said assembled tubes is oblong.

12. The heat exchanger as claimed in claim 1, configured such that one of the two fluids is a gas under high pressure and the other fluid is a liquid.

13. The heat exchanger as claimed in claim 1, wherein said adjacent tubes are brazed together at said contact points.

14. A heat exchanger for an air-conditioning circuit of a vehicle, allowing an exchange of heat between first and second fluids, said exchanger comprising:

a plurality of tubes for circulation of the first fluid stacked on top of each other, each of the plurality of tubes comprising two ends;

at least one collector comprising a collector plate, a cover, and an intermediate reinforcing plate, said collector plate comprising openings for insertion of the ends of the plurality of tubes; and a supplementary plate comprising first webs, wherein said ends of said plurality of tubes are assembled at least two by two in a same of said insertion openings of the collector plate, wherein adjacent tubes are in contact with each other between ends of said adjacent tubes, wherein said intermediate reinforcing plate comprises openings for passage of the fluid and rests on said collector plate, wherein said reinforcing plate forms a brace between said cover and said collector plate, and wherein said supplementary plate allows brazing of said cover and said reinforcing plate together, wherein said reinforcing plate comprises second webs, said collector plate comprises collars bordering said openings of said collector plate, and said collector is configured such that said collars rest on said second webs.

* * * * *